US008186798B2

(12) United States Patent
Aoki et al.

(10) Patent No.: US 8,186,798 B2
(45) **Date of Patent: *May 29, 2012**

(54) INK JET RECORDING APPARATUS THAT MEASURES CHANGE IN TEMPERATURE AFTER HEATER IS DRIVEN AND DETERMINES DISCHARGE STATE AND METHOD FOR DETERMINING DISCHARGE STATE

(75) Inventors: Takatsuna Aoki, Yokohama (JP); Makoto Shihoh, Yokohama (JP); Seiichiro Karita, Toda (JP)

(73) Assignee: Canon Kabushiki Kaisha, Tokyo (JP)

( * ) Notice: Subject to any disclaimer, the term of this patent is extended or adjusted under 35 U.S.C. 154(b) by 721 days.

This patent is subject to a terminal disclaimer.

(21) Appl. No.: 11/761,945

(22) Filed: Jun. 12, 2007

(65) Prior Publication Data

US 2007/0291067 A1 Dec. 20, 2007

(30) Foreign Application Priority Data

Jun. 20, 2006 (JP) ..... 2006-170246

(51) Int. Cl.
*B41J 29/38* (2006.01)

(52) U.S. Cl. ..... 347/19; 347/14

(58) Field of Classification Search ..... 347/19, 347/15, 14

See application file for complete search history.

(56) References Cited

U.S. PATENT DOCUMENTS

| | | | | |
|---|---|---|---|---|
| 5,530,462 | A | 6/1996 | Takahashi et al. | |
| 6,634,731 | B2 * | 10/2003 | Kao et al. | 347/14 |
| 6,644,774 | B1 * | 11/2003 | Burger et al. | 347/19 |
| 2002/0063745 | A1 * | 5/2002 | Osborne | 347/19 |
| 2007/0291069 | A1 * | 12/2007 | Shihoh et al. | 347/19 |

FOREIGN PATENT DOCUMENTS

| | | | |
|---|---|---|---|
| JP | 3-234636 | A | 10/1991 |
| JP | 6-079956 | A | 3/1994 |

* cited by examiner

*Primary Examiner* — Laura Martin

(74) *Attorney, Agent, or Firm* — Canon USA Inc IP Division

(57) ABSTRACT

In an ink jet recording apparatus using a recording head that discharges ink by applying thermal energy produced in response to driving a heater to ink, a change in temperature occurring when the heater is driven is measured by a temperature sensor disposed directly below the heater. A discharge state for each nozzle can be determined by determination as to whether an inflection point is present in a curve representing the change in temperature occurring after the driving for discharging ink.

5 Claims, 6 Drawing Sheets

INK JET RECORDING APPARATUS THAT MEASURES CHANGE IN TEMPERATURE AFTER HEATER IS DRIVEN AND DETERMINES DISCHARGE STATE AND METHOD FOR DETERMINING DISCHARGE STATE

BACKGROUND OF THE INVENTION

1. Field of the Invention

The present invention relates to an ink jet recording apparatus that uses a recording head that discharges droplets of ink by creating a bubble in the ink by using thermal energy produced by a heater, i.e., an electrothermal transducer. The ink jet recording apparatus records various kinds of information, including an image, on a recording medium by placing droplets of recording ink discharged from nozzles of the recording head onto the recording medium.

2. Description of the Related Art

One known example of such an ink jet recording method, which places ink onto a recording medium, such as a sheet of paper, by discharging the ink (droplets of recording ink) from discharge ports of a recording head, is a discharge method in which thermal energy is applied to ink to discharge the ink from the discharge ports. This discharge method is advantageous in that a high-density multi-nozzle recording head can be easily realized. However, an ink jet recording apparatus that uses a recording head operating in such a discharge method may suffer from a discharge defect occurring in the entire recording head or part of nozzles because of clogging of a nozzle caused by a foreign object, of a bubble undesirably introduced in an ink supply channel, or of a change in wettability of a nozzle surface.

When a discharge defect occurs in a nozzle of a recording head, a recovery operation for recovering a discharge state can be executed. In the case of a so-called serial ink jet recording apparatus, which records information by alternately repeating a scan by a recording head in the forward and reverse directions and a conveyance of a recording sheet being a recording medium, the recovery operation can be executed after the recording head is moved outside the recording sheet. In contrast to this, in the case of a full-line type recording apparatus, in which nozzles corresponding to the entire width of a recording medium are arranged in rows, a recording operation is significantly fast, and the recording head cannot be moved outside the recording medium during the recording operation. Therefore, it is desirable to immediately locate a nozzle suffering from a discharge defect and, when the defective nozzle is located, to utilize the detective nozzle location information for compensating for the defect to form a correct image and for a recovery operation for a recording head.

To address this problem of discharge defects, there has been proposed various methods for detecting the presence of a discharge defect, for compensating for the discharge defect, control methods, apparatuses, various methods for controlling the amount of discharge, and apparatuses therefor.

Japanese Patent Laid-Open No. 6-079956 discloses an example of a printing method that determines a printed article to obtain a defect-free image. This method prints a predetermined pattern on a sheet for detection, reads the printed pattern by a reading device, and detects an abnormal print element. More specifically, the structure moves image data to be applied to the abnormal print element so that the image data is superimposed on image data for another print element to compensate for defects that would occur in printing to obtain a defect-free image.

For a structure that uses a recording head having a width equal to the sheet width, the use of a detecting unit (reading head) configured to detect whether ink has been discharged to equalize the discharge state in the ink jet recording head is known. For example, Japanese Patent Laid-Open No. 3-234636 discloses a structure that includes a detecting unit configured to detect whether ink has been discharged and sets control in accordance with the detected drive condition.

In addition, U.S. Pat. No. 5,530,462 discloses a method for detecting flying ink droplets for use in a structure that includes a set of a light emitting element and a light receiving element disposed adjacent to both ends of an array of discharge ports of a recording head. This method determine a discharge state of the recording liquid for each discharge port by using a detecting unit configured to detect discharged recording liquid. U.S. Pat. No. 4,550,327 discloses a structure that determines a discharge state at a discharging source. The structure includes a conductive element disposed at a position subjected to thermal effects produced by a heater and detects a change in resistance varying depending on the temperature.

U.S. Pat. No. 6,074,034 discloses another structure for detecting ink droplets at a discharging source. The structure includes heaters and a temperature detecting element disposed on the same support (e.g., a silicon substrate). In this structure, the film temperature detecting element is disposed so as to overlap a region where the heaters are arranged. The structure determines a discharge defect on the basis a change in resistance of the temperature detecting element varying with the change in temperature. In addition, the film temperature detecting element is formed on a heater board by a deposition process, and a terminal thereof is connected to the exterior by wire bonding.

The method for detecting an abnormal state of a nozzle disclosed in Japanese Patent Laid-Open No. 6-079956, described above, detects an abnormal print element from a result of reading a check pattern printed on a sheet of paper. It is thus necessary to print the pattern before detection of a discharge defect, and therefore, it is significantly difficult to immediately detect a discharge defect. Moreover, a reading device is required, so the equipment cost is undesirably increased.

For the structures disclosed in Japanese Patent Laid-Open No. 3-234636 and U.S. Pat. No. 5,530,462, described above, it is difficult to miniaturize the apparatus and reduce the cost and also hard to immediately detect a nozzle suffering from a discharge defect.

The patent documents described above do not disclose a structure that can immediately detect a discharge defect for each nozzle without having to increase equipment size.

SUMMARY OF THE INVENTION

An embodiment of the present invention provides a method for detecting a discharge state for each nozzle at high speed without having to increase equipment size and also provides an ink jet recording apparatus.

According to a first aspect of the present invention, an ink jet recording apparatus that records information by discharging ink on a recording medium using a recording head includes a recording head, a temperature measuring unit, and a determining unit. The recording head has a plurality of discharge ports. The recording head is configured to discharge ink from each of the discharge ports in response to driving of a corresponding heater that produces thermal energy. The temperature measuring unit is configured to, when the heater is driven in response to an application of a drive voltage for discharging ink, measure a change in temperature adjacent to the heater. The determining unit is configured to determine whether an inflection point is present within a range where a temperature falls after a temperature rises in a curve representing the change in temperature measured by the temperature measuring unit. The determining unit determines that a discharge state of a discharge port subjected to the determination is not normal when the inflection point is not present.

According to a second aspect of the present invention, a method for detecting a discharge state for use in an ink jet recording apparatus for recording information by discharging ink on a recording medium using a recording head is provided. The recording head has a plurality of discharge ports and is configured to discharge ink from the discharge ports in response to driving of a heater that produces thermal energy. The method includes a driving operation, a temperature measuring operation, and a determining operation. The driving operation applies a drive voltage for discharging ink and drives the heater. The temperature measuring operation measures a change in temperature adjacent to the heater when the heater is being driven. The determining operation determines whether an inflection point is present within a range where the temperature falls after the temperature rises in a curve representing the change in temperature measured in the temperature measuring step. The determining operation determines that a discharge state of a discharge port subjected to the determination is not normal when the inflection point is not present.

According to an embodiment, it can be determined whether a discharge state of a nozzle is normal or abnormal on the basis of the presence or absence of an inflection point in a curve that represents a change in temperature while the temperature falls when a heater is driven to discharge ink. According to an embodiment, monitoring the change in temperature during driving of a recording head enables the occurrence of a discharge defect to be immediately detected. Therefore, when the discharge defect occurs, processing for recovering discharge, processing for protecting the recording head, and warning to a user can be immediately performed.

Further features of the present invention will become apparent from the following description of exemplary embodiments (with reference to the attached drawings).

DESCRIPTION OF THE EMBODIMENTS

First Embodiment

A first embodiment of the present invention will be described below with reference to the drawings.

First, an ink jet recording apparatus to which an embodiment of the present invention is applicable will be described.

Figure 5:
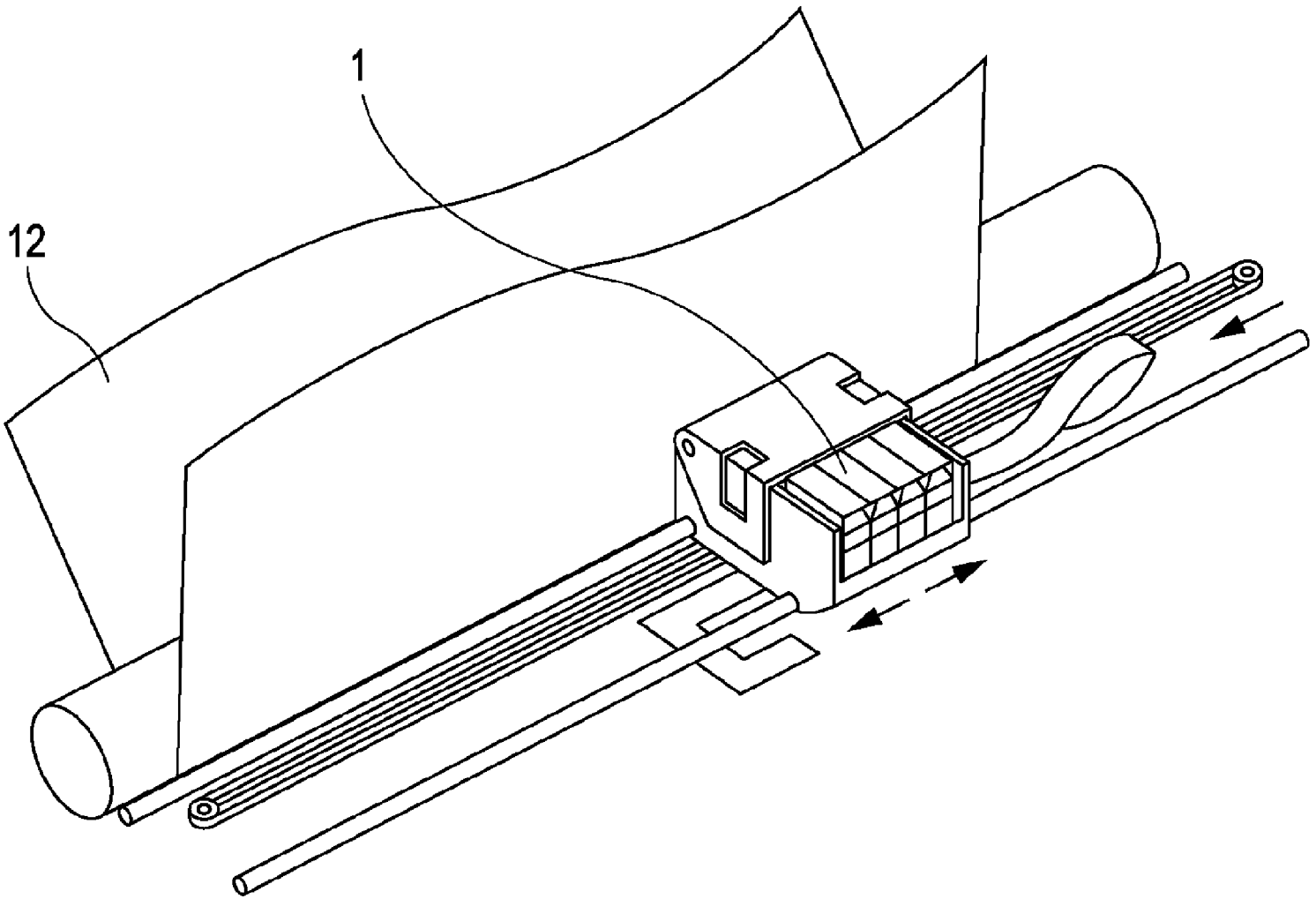
FIG. 5 is a perspective view of a serial ink jet color printer.

FIG. 5 is a schematic illustration of a main portion of a serial ink jet color printer. A recording head 1 includes a plurality of nozzle arrays, each having a plurality of nozzles arranged therein. The recording head 1 is a device that discharges ink droplets from discharge ports (not shown) corresponding to the nozzles to record information, including an image, on a recording medium 12.

Figure 4A:
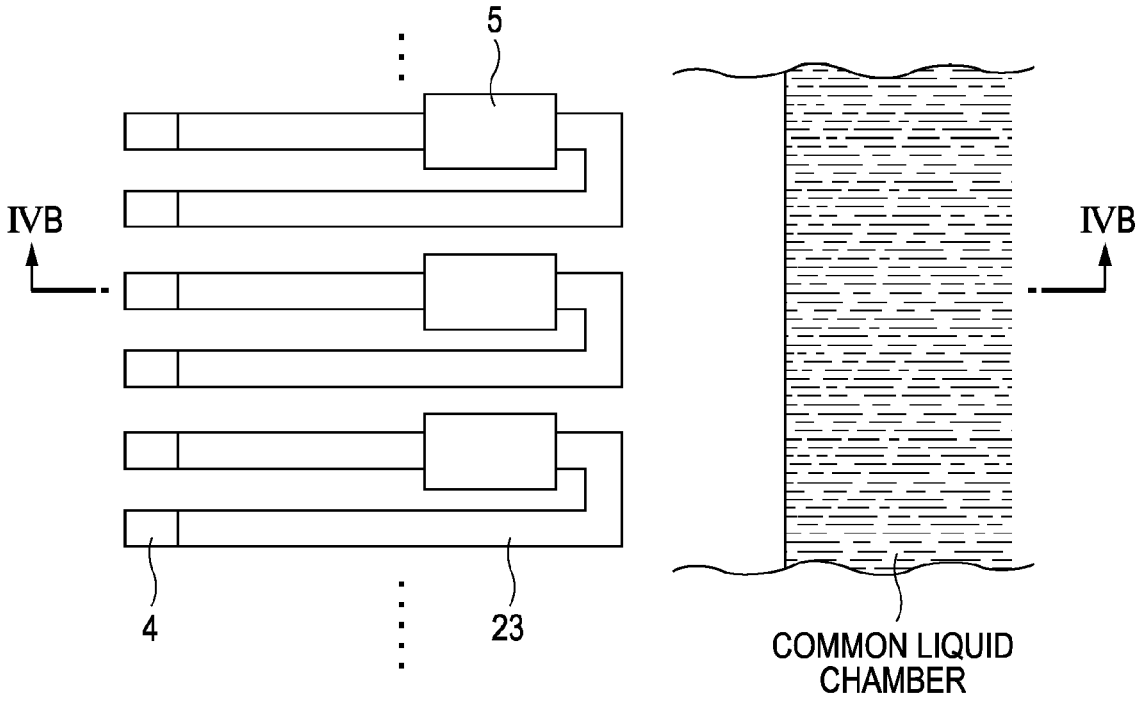
FIGS. 4A and 4B are a partial schematic plan view and cross-sectional view of an ink jet recording head to which the present invention is applicable, respectively.
Figure 4B:
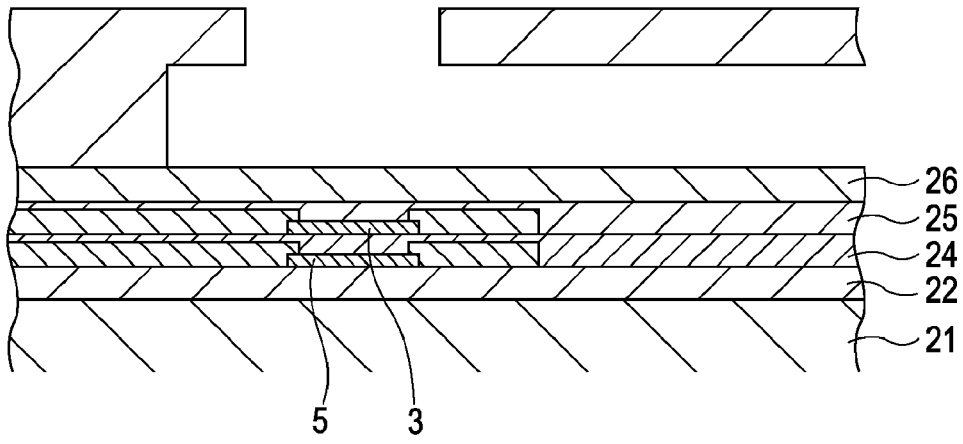

FIGS. 4A and 4B illustrate a structure of a temperature detecting element disposed on the recording head 1. FIG. 4A is a partial schematic plan view of a substrate of the recording head 1. FIG. 4B is a partial schematic cross-sectional view of the substrate of the recording head 1.

An electrothermal transducer 3 (hereinafter referred to as a discharge heater 3) for producing thermal energy in response to a supply of an application voltage to cause ink droplets to be discharged from the plurality of discharge ports arranged in a row is disposed on a heater board. The discharge heater 3 is provided for each discharge port. The heater board includes a thermal storage layer 22 made of, for example, a thermal-oxide film (silicon oxide ($SiO_2$)). An ink channel is disposed above the discharge heater 3. An application of a drive signal to these discharge heaters 3 corresponding to the discharge ports heats ink inside the discharge ports and causes ink droplets from the discharge ports. That is, ink in the ink channel above the discharge heaters 3 is discharged from the respective discharge ports.

In FIG. 4A, terminals 4 are used to connect to the exterior by wire bonding. Temperature detecting elements 5 (hereinafter referred to as temperature sensors 5) are used to measure temperature and disposed below the discharge heaters 3. The temperature sensors 5 are formed on the heater board by the same deposition process as in the discharge heaters 3. An embodiment of the present invention measures a rise and a fall in temperature resulting from driving of the discharge heaters by using the temperature detecting elements corresponding to the nozzles, thereby determining a discharge state of each nozzle subjected to the determination.

FIG. 4B illustrates a schematic cross-sectional view of a portion that includes one of the temperature sensors 5 illustrated in FIG. 4A. A silicon substrate 21 is provided with an individual lead 23 (shown in FIG. 4A) made of, for example, aluminum for connecting to the temperature sensor 5 via the thermal storage layer 22 and an aluminum lead for connecting the discharge heater 3 to a control circuit of the silicon substrate 21. The temperature sensor 5 is made of a thin-film resistor that has a resistance varying with a change in temperature. Examples of the material of the thin-film resistor include Al, Pt, Ti, TiN, TiSi, Ta, TaN, TaSiN, TaCr, Cr, CrSi, CrSiN, W, $WSi_2$, WN, Poly-Si, α-Si, Mo, MoSi, Nb, and Ru. Furthermore, the discharge heater 3, via an interlayer dielectric 24, a passivation layer 25 made of, for example, SiN, and an anti-cavitation layer 26 are densely stacked on the silicon substrate 21 by a semiconductor process. The anti-cavitation layer 26 is a layer for increasing cavitation resistance properties on the discharge heater 3. One example of the material of the anti-cavitation layer 26 is a tantalum layer. The temperature sensor 5 is disposed directly below the corresponding discharge heater 3. The temperature sensors 5 are separated from each other for each of the discharge heaters 3. The individual lead 23 connected to each of the temperature sensors 5 is constituted as part of a detection circuit for detecting information of the temperature sensor 5. According to the structure of the recording head described in the present embodiment, each component is patterned by use of a suitable manufacturing process for an ink jet recording head. Therefore, in an embodiment, it is not necessary to change the conventional structure of a recording head, and this is also highly advantageous in terms of industrial production.

The temperature sensor 5 has a rectangular shape in plan in the present embodiment. However, the temperature sensor 5 may have a serpentine shape in order to output a high voltage value even with a minute temperature change with the aim of obtaining higher resistance.

Figure 6:
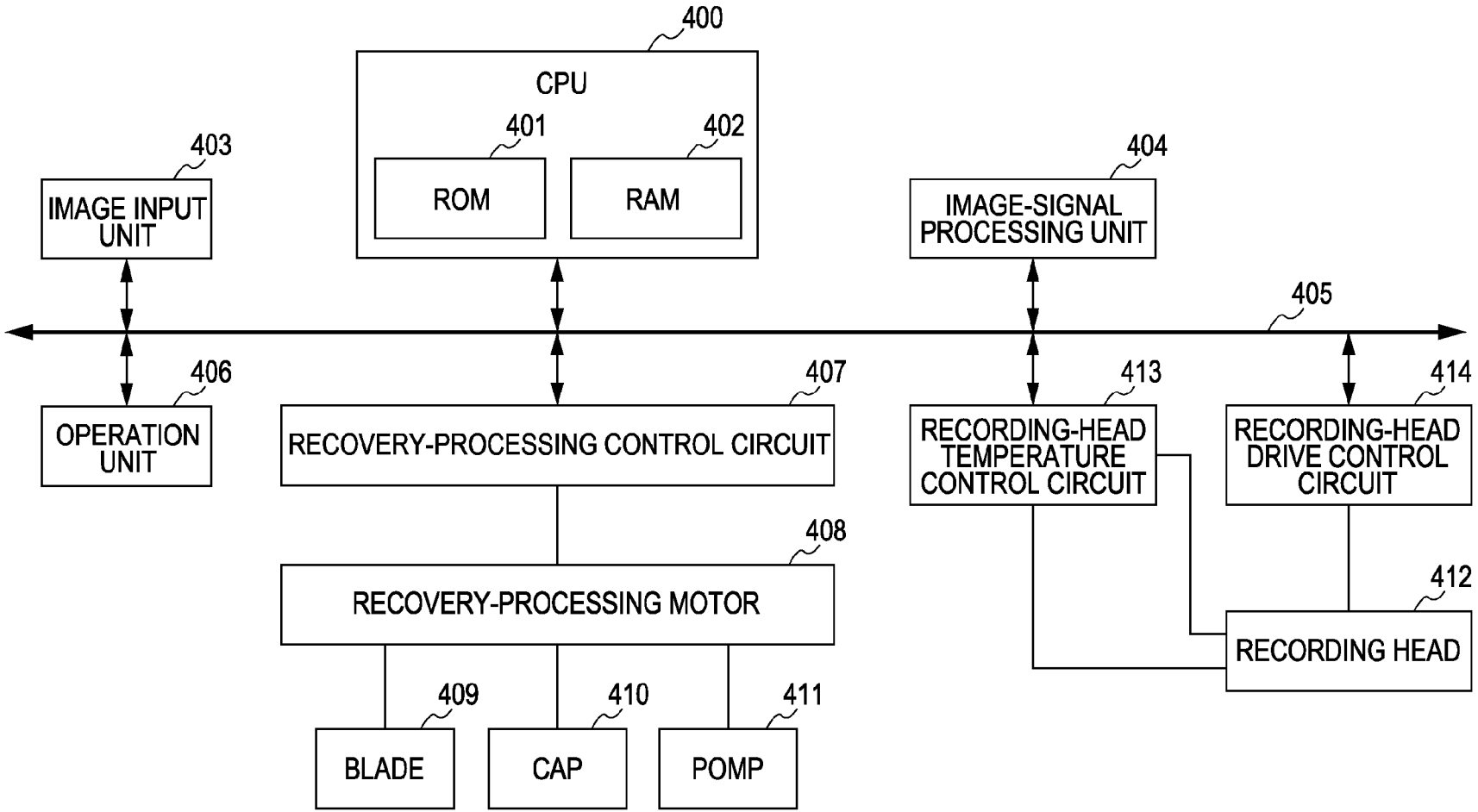
FIG. 6 is a block diagram illustrating a control structure of a recording apparatus.

FIG. 6 is a block diagram of a control circuit of the recording apparatus. As illustrated in FIG. 6, the control circuit is constructed such that each of an image input unit 403, an image-signal processing unit 404, and a central processing unit (CPU) 400 can make access to a main bus 405.

The CPU 400 includes a read-only memory (ROM) 401 and a random-access memory (RAM) 402. The CPU 400 performs control for supplying an appropriate recording condition in response to received information, driving a recording head 412, and thus recording information. A program for executing a recovery procedure for the recording head 412 is previously stored in the RAM 402. The CPU 400 supplies a recovery condition, such as a preliminary discharge condition, to a recovery-processing control circuit 407 and the recording head 412, as needed. A recovery-processing motor 408 drives the recording head 412, a (cleaning) blade 409, a cap 410, and a suction pump 411. The recording head 412 faces the blade 409, the cap 410, and the suction pump 411. A recording-head temperature control circuit 413 controls the temperature of the recording head 412 based on an output of a temperature sensor (not shown) of the recording head 412. When the temperature of the recording head 412 is below a desired temperature, the recording-head temperature control circuit 413 enables the temperature of the recording head 412 to be maintained in a desired range by driving a heater (not shown) for use in temperature adjustment. The recording apparatus also includes an operation unit 406 for causing the recording apparatus to execute a predetermined operation in response to a user action. The use of the operation unit 406 enables a variety of operations, such as a manual recovery operation, switching on/off of a power supply, and a test print.

A recording-head drive control circuit 414 drives the discharge heater 3, which is an electrothermal transducer of the recording head 412, in accordance with a drive condition supplied from the CPU 400 and causes the recording head 412 to perform preliminary discharge or recording-ink discharge.

Figure 1:
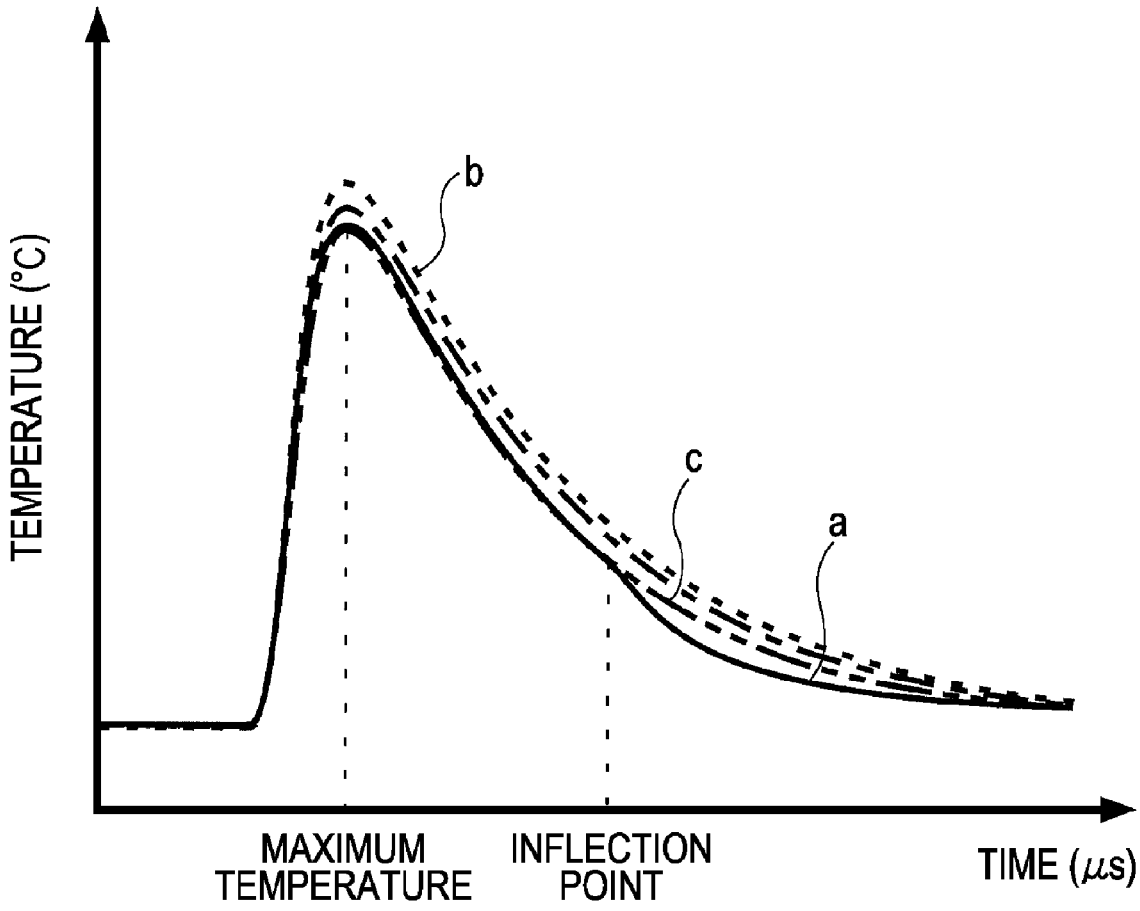
FIG. 1 illustrates a change in temperature measured by a sensor when a heater is driven for each discharge state.

FIG. 1 illustrates curves representing changes in temperature with respect to time when a drive voltage for discharging ink is applied to the discharge heaters 3. FIG. 1 indicates that temperature profiles measured by the temperature sensors 5 are different depending on the difference between the discharge states of nozzles. A curve "a" illustrated in FIG. 1 represents a change in temperature occurring when the ink discharge state is normal. In the case in which the nozzle is in a state that is able to normally discharge ink, if a drive condition is constant, after a predetermined time from the time when the temperature measured by the temperature sensor 5 reaches a maximum, a point where the rate at which the temperature falls markedly changes is present. This point is hereinafter referred to as an inflection point. In the case of a nozzle shape used in the present embodiment, the inflection point appears after approximately 4.2 μs from the time when the temperature measured by the temperature sensor 5 reaches the maximum. The time of the presence of the inflection point varies depending on conditions, such as a structure of the recording head, including that of the discharge port and that of the ink channel, and heat performance of the heater. As a result, the timing for use in the determination as to whether the inflection point is present can be appropriately set for each recording head.

In the case of a state that is unable to normally discharge ink, as indicated by a curve "b" illustrated in FIG. 1, a change in the inclination of the curve is not present while the temperature falls. One example of the state that exhibits such a temperature change is a discharge defect caused by a situation in which remaining bubbles are in contact with the anti-cavitation layer 26. When remaining bubbles are in contact with the anti-cavitation layer 26, heat cannot be conveyed from the discharge heater 3 to ink and thus the ink does not have a phase change, so the ink is not normally discharged. This state is referred to as "a discharge-defect state caused by bubbles".

A curve "c" illustrated in FIG. 1 represents a change in temperature occurring when ink is not normally discharged because the adjacent areas of the discharge port becomes clogged. Also in this case, as is obvious from the drawing, at a timing at which the inflection point is present in normal discharge, an inflection point is not present. A curve indicated by a dashed-dotted line represents a change in temperature for a discharge defect resulting from clogging of the ink channel.

Similarly, in abnormal discharge states other than the above-described cases, an inflection point is not present while the temperature falls in a curve representing a change in temperature measured by the temperature sensor 5 or an inflection point is present at a different timing from that in normal discharge. Therefore, it is determined whether ink is normally discharged from the discharge port on the basis of calculation of a change in temperature measured by the temperature sensor 5 within a predetermined time range.

Figure 2A:
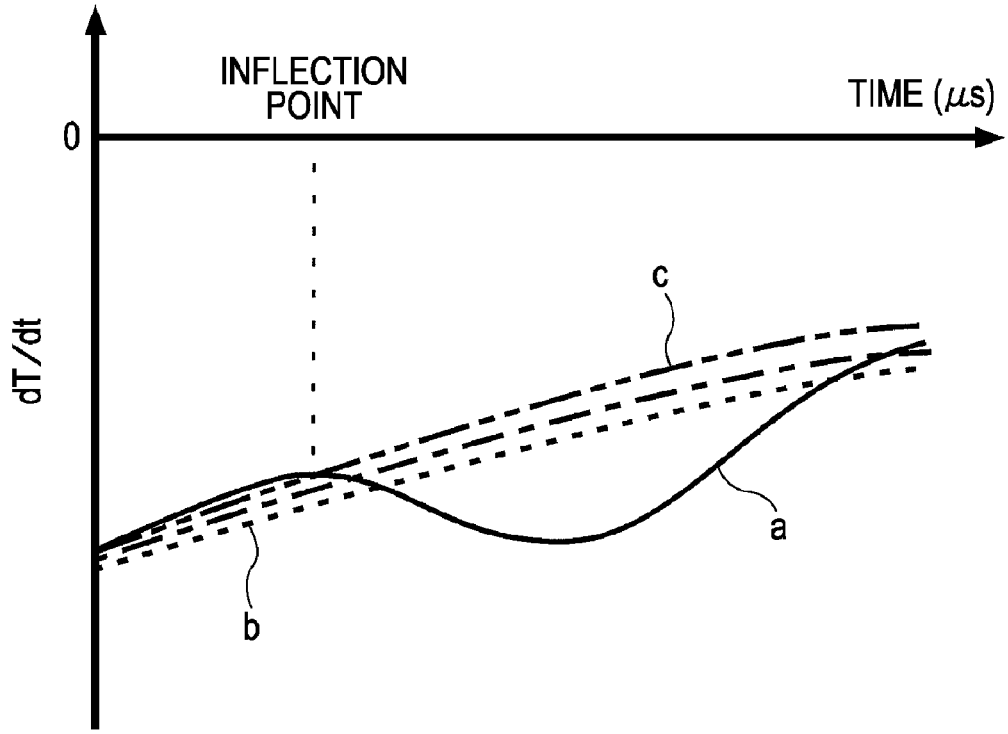
FIGS. 2A and 2B are a graph of a first derivative of the change in temperature measured by the sensor and a graph of a second derivative thereof with respect to time, respectively.

FIG. 2A illustrates a graph that indicates a first derivative of a change in temperature measured by the temperature sensor 5 within a range from 1 μs before the time of occurrence of an inflection point to 1 μs after the time thereof in normal discharge. FIG. 2A illustrates the states of "a", "b", and "c", illustrated in FIG. 1. A profile "a", which is in normal discharge, shows that a first derivative has the maximum value and the minimum value in a period of time when the inclination changes while the temperature falls. In the cases of "b" and "c", a change appearing in the case of "a" is not recognized.

Figure 2B:
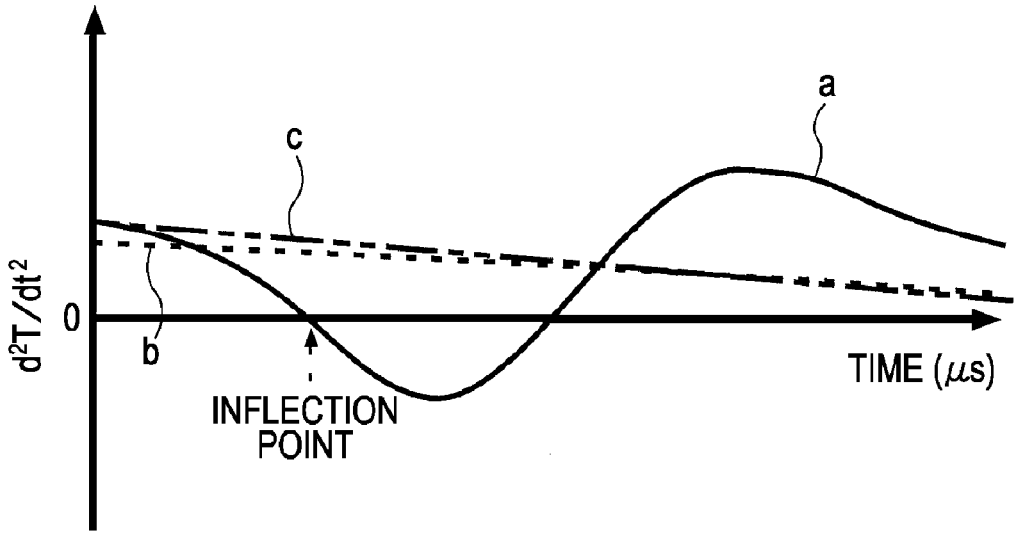

FIG. 2B illustrates a graph that indicates a derivative in which the result illustrated in FIG. 2A is further differentiated with respect to time. FIG. 2B shows that a negative peak is present in normal discharge. In contrast to this, when ink is not normally discharged, a peak that has a negative value is not present.

A comparison between FIG. 2A and FIG. 2B shows that the difference between output values for a waveform of a first derivative of a temperature profile is larger than that for a waveform of a second derivative thereof. Therefore, in terms of a system for determining an abnormal discharge state, a second derivative of a measured change in temperature, as illustrated in FIG. 2B, can be used. An example of another method for detecting an inflection point of a curve representing a change in temperature is detection by using a change in curvature of a temperature profile. The present invention is not limited to the methods described above. Any other method that can detect the presence of an inflection point from a measured change in temperature can be used.

Figure 3:
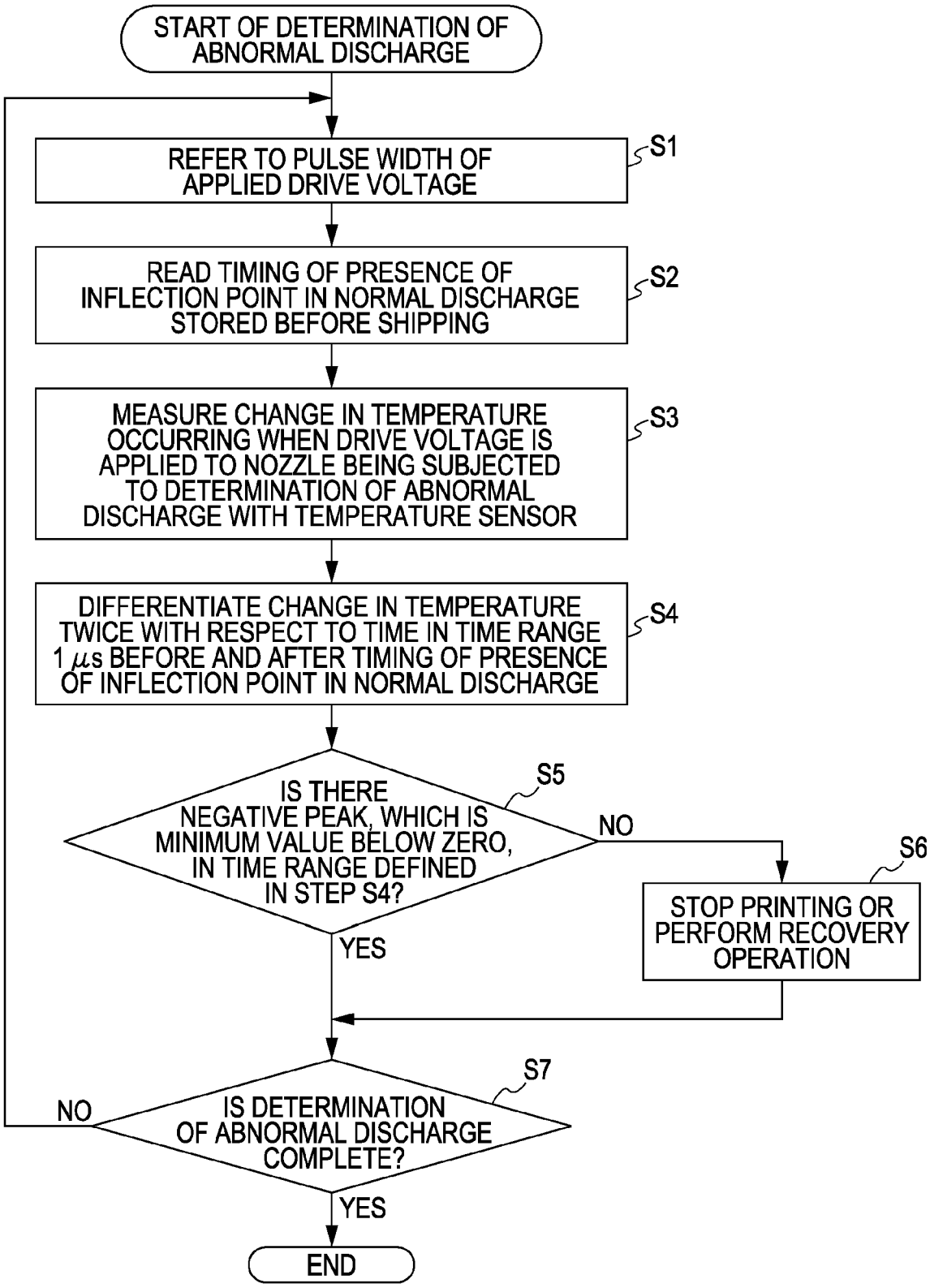
FIG. 3 is a flowchart illustrating a process of determining an abnormal discharge state according to an embodiment of the present invention.

FIG. 3 is a flowchart that illustrates a process of determining an abnormal discharge state of a nozzle according to an embodiment.

A flow of the process of determining a discharge defect will be described with reference to FIGS. 1 and 3.

In step S1, the pulse width of a drive voltage applied to the discharge heater 3 is referred to.

In step S2, in response to the drive waveform referred to in step S1, the timing of the presence of an inflection point in normal discharge is read from a storage element. The inflection point in normal discharge can be stored prior to shipping, for example, in an inspection at a factory. Here, the timing previously stored prior to shipping is read from a storage element, such as a memory.

In step S3, a change in temperature occurring when the drive voltage is applied to a nozzle subjected to the process of determining an abnormal discharge state is measured by the temperature sensor 5.

In step S4, a change in temperature measured in step S3 is differentiated twice with respect to time. This differentiation is performed within a time range 1 μs before and after the timing of the presence of the inflection point read in step S2.

In step S5, it is determined whether a profile of a second derivative of the change in temperature calculated in step S4 has a negative peak, which is a minimum value below zero. If the negative peak is present in the time range defined in step S4, the discharge state is determined to be normal. If the negative peak is not present in the time range defined in step S4, the discharge state is determined to be abnormal.

If it is determined that the discharge state is normal (YES in step S5), flow proceeds to step S7. If it is determined that the discharge state is abnormal (NO in step S5), flow proceeds to step S6, where printing pauses or a recovery operation starts, and flow then proceeds to step S7.

In step S7, it is determined whether the process of determining an abnormal discharge state has been completed. If it has not been completed (NO in step S7), a subject of the process of determining an abnormal discharge state is shifted to another nozzle, and steps S1 to S5 are repeated until a signal that indicates the completion of the process of determining an abnormal discharge state is detected.

In the flow described above, step S6, which comes after the discharge state is determined to be abnormal in step S5, is not limited to pausing of printing or execution of the recovery operation. For example, in step S6, a nozzle determined to be in an abnormal discharge state may be stored, and a determination process of steps S3 to S5 may be repeated until the process of determining an abnormal discharge state has been completed for all nozzles. In this case, it is possible to carry out a necessary recovery operation or stop printing after the completion of the process of determination for all nozzles.

Second Embodiment

A second embodiment will be described below.

In the first embodiment, the discharge state is determined by calculation of a measured change in temperature and determination as to the presence or absence of an inflection point while the temperature falls.

The present invention is not limited to the first embodiment described above. Another method for determining an abnormal discharge state is comparison between the shape of a temperature curve in normal discharge and that in abnormal discharge.

For example, a curve that represents a change in temperature in normal discharge is previously stored, and a measured change in temperature is compared therewith. That is, the discharge state is determined on the basis of the difference between the measured change in temperature and the previously stored change in temperature in normal discharge.

As described above, the use of a method for accurately determining a discharge defect in such a way that comparison is performed at a single point enables the discharge state to be determined promptly and precisely for each nozzle. As a result, even when abnormal discharge occurs in continuous printing, compensation by another nozzle or a recovery operation is appropriately performed, or alternatively, printing appropriately stops. This obviates the risk of outputting large amounts of printed materials with degraded image quality, and therefore, the image quality is maintained at high level.

Other Embodiments

In the above embodiments, a serial ink jet recording apparatus is described by way of example with reference to FIG. 5. The present invention is not limited to a recording apparatus that uses a method illustrated in FIG. 5. For example, the present invention is applicable to a recording apparatus that uses a so-called full-line recording head, in which nozzles are arranged in the entire width along the width of a sheet of recording paper.

In the present embodiment, the neighborhood of the timing of the presence of an inflection point while the temperature falls is a subject of calculation. The presence or absence of an inflection point in a curve that represents a change in temperature is determined by sampling a change in temperature from the start of driving of a heater to the decrease of the temperature.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-170246 filed Jun. 20, 2006, which is hereby incorporated by reference herein in its entirety.

What is claimed is:

1. An ink jet recording apparatus that records information by discharging ink on a recording medium using a recording head, the ink jet recording apparatus comprising:

a recording head having a discharge port, the recording head being configured to discharge ink from the discharge port in response to driving of a heater that produces thermal energy;

a temperature measuring unit configured to measure a temperature adjacent to the heater, and to, when the heater is driven in response to an application of a drive voltage for discharging ink from the discharge port, measure a change in temperature adjacent to the heater; and a determining unit configured to determine whether a predetermined point to be calculated by second-order differentiation is present within a range where a temperature falls after a temperature rises in a curve representing the change in temperature measured by the temperature measuring unit, wherein the determining unit determines whether the predetermined point is present based on a result of calculation of the change in temperature in a predetermined time range including a timing at which the predetermined point is present in a normal discharge state, wherein the determining unit determines that a discharge state of the discharge port is normal when the predetermined point is present and the discharge state of the discharge port is not normal when the predetermined point is not present.

2. The ink jet recording apparatus according to claim 1, wherein the recording head includes the heater such that the heater heats ink in an ink channel disposed above the heater, and the recording head includes a temperature sensor for measuring the temperature, the temperature sensor being disposed below the heater, and, wherein the temperature measuring unit measures the change in temperature based on an output of the temperature sensor.

3. The ink jet recording apparatus according to claim 1, wherein the recording head comprises a plurality of discharge ports, a plurality of heaters corresponding to the plurality of discharge ports, and a plurality of temperature measuring units corresponding to the plurality of discharge ports, and, wherein the determining unit determines the discharge state for each of the discharge ports.

4. The ink jet recording apparatus according to claim 1, wherein the calculation performed by the determining unit is a first derivative of a waveform of the measured change in temperature.

5. The ink jet recording apparatus according to claim 4, wherein the calculation performed by the determining unit is a second derivative in which the first derivative is differentiated with respect to time.

* * * * *